United States Patent [19]

Amundsen

[11] Patent Number: 5,070,653

[45] Date of Patent: Dec. 10, 1991

[54] CENTERLESS VALVE REGRINDER

[75] Inventor: L. Carl Amundsen, Albany, Ga.

[73] Assignee: Ran Can Corp., Albany, Ga.

[21] Appl. No.: 367,464

[22] Filed: Jun. 16, 1989

[51] Int. Cl.[5] ..... B24B 15/04

[52] U.S. Cl. ..... 51/105 VG; 51/217 T; 51/215 SF

[58] Field of Search ..... 51/105 VG, 217 T, 216 T, 51/236, 237, 95 WH, 129, 131.1, 215 AR, 215 SF

[56] References Cited

U.S. PATENT DOCUMENTS

| | | | |
|---|---|---|---|
| 1,202,400 | 10/1916 | McCullough | 51/131.1 |
| 1,393,046 | 10/1921 | Singer | 51/238 GG |
| 1,422,749 | 7/1922 | Dameron | 51/98 R |
| 1,452,508 | 4/1923 | Hervig | 51/105 VG |
| 1,510,831 | 10/1924 | Crowe | 51/105 VG |
| 1,533,133 | 4/1925 | Nickau | 82/172 |
| 1,590,190 | 6/1926 | Heim | 430/228 |
| 1,602,135 | 10/1926 | Tryon | 51/237 R |
| 1,691,061 | 11/1928 | Heim | 51/238 GG |
| 2,059,895 | 11/1936 | Norton | 51/103 |
| 2,221,918 | 11/1940 | Hall | 51/105 |
| 2,389,787 | 11/1945 | Kuhns | 51/103 |
| 2,544,318 | 3/1951 | Horberg | 51/103 |
| 2,567,320 | 9/1951 | Christensen | 51/103 |
| 2,576,333 | 11/1951 | Earll | 51/216 T |
| 2,863,263 | 12/1958 | Perkes | 51/238 |
| 2,927,404 | 3/1960 | Shoffner | 51/98 |
| 2,939,253 | 6/1960 | Richard | 51/103 |
| 3,041,691 | 7/1962 | Vanier | 214/1 |
| 3,066,457 | 12/1962 | Moore | 51/237 |
| 3,140,569 | 7/1964 | Murray | 51/236 |
| 3,857,204 | 12/1974 | Richard | 51/103 |
| 4,428,160 | 1/1984 | Willemsen | 51/129 |

*Primary Examiner*—Robert A. Rose

*Attorney, Agent, or Firm*—Sutherland, Asbill & Brennan

[57] ABSTRACT

A centerless valve regrinder for resurfacing a worn valve having a face, a tulip connected to the face, a valve stem connected to the tulip, the stem having an axis, a first notch worn into the stem at a location spaced from the tulip, and a second notch worn into the stem at a second location spaced from a distal end of the stem. The regrinder is comprised of a power-driven means for resurfacing said valve face, and a chuck for supporting the valve stem in such an orientation as to cause contact between the valve face and the means for resurfacing at the angle of bevel of the valve face. The chuck is also comprised of a wheel for rotating the stem about its axis and simultaneously drawing the valve face into contact with the means for resurfacing. The chuck is further comprised of two fixed supports that are in parallel orientation and of sufficient length to cradle and support the stem from respective points adjacent the tulip to respective points past the first notch, and preferably past the second notch. Preferably, there is no stop member to contact the distal end of the stem to limit the regrinding.

29 Claims, 4 Drawing Sheets

CENTERLESS VALVE REGRINDER

BACKGROUND OF INVENTION

1. Field of Invention

The present invention relates to a centerless valve regrinder for valves used in an internal combustion engine. More particularly, this invention relates to a chuck for supporting the valve and rotating its face against a moving, abrading surface.

2. Description of the Related Art

A valve for an internal combustion engine consists essentially of a straight stem having a valve tulip on one end. The tulip has an upper surface that is substantially perpendicular to the axis of the stem and a fluted undersurface that joins with the stem. The undersurface has beveled face ground therein. The face mates with a seat in a head or block of the engine to form a seal. A valve is used for opening a piston cylinder, either to allow the input of fuel and oxygen to the cylinder or to allow the removal of exhaust. The valve is closed to form a seal to allow combustion of the fuel to power the engine. A valve becomes worn after it has been used in an engine for a period of time, and the mating between the valve face and seat forms less of a seal, thereby reducing the power of the engine. Rather than discard the valve, the valve face can be reground to improve the seal by means of a centerless valve regrinder.

The invention disclosed hereinafter is directed to solving certain longstanding problems that have escaped solution due to an apparent failure to understand certain important phenomena relating to centerless valve regrinders.

Consider the following passage from U.S. Pat. No. 2,567,320 ("CHRISTENSEN"):

> Heretofore various types of valve facing devices have been used but have not been found entirely satisfactory for various reasons. Prior devices have been large and unwieldy as well as costly to manufacture. In addition, these prior devices have been difficult to adjust and operate and of complex construction.
>
> An object of the present invention is to provide a valve facing device of simple construction overcoming the drawbacks of previous devices.
>
> A further object is to provide a simplified construction of a portable facing device having adjusting means which are easily and quickly operable by experienced persons.
>
> Still another object is to provide a valve face of the character described which has accurate securing and holding means for a valve to be faced and which are quickly and easily placed into or out of operable position.
>
> Yet another object of the invention is to provide improved means for rotatably and angularly holding a valve for facing with a minimum of time and skill required for adjustment and operation thereof.

At Col. 1, lines 1–31.

Compare CHRISTENSEN, a 1950 patent, with U.S. Pat. No. 3,140,569 ("MURRAY"), a 1964 patent.

> In prior art devices for grinding valves and refacing valves elaborate chuck means ar provided and consequently such devices are costly. My invention, on the other hand, is of simple construction and of a cost that makes them available for use in small shops and garages.

> It is, therefore, an object of my invention to provide a simplified valve grinding machine wherein a valve may be ground quickly and accurately.
>
> It is another object of my invention to provide a simplified holding means for a valve to be ground which permits facile rotation and removal of said valve.

At Col. 1, lines 12–22.

Many patents in this field of technology mention increased simplicity and decreased cost as objects of the invention. Yet compare the ever increasing complexity of the prior art devices, e.g., CHRISTENSEN and MURRAY, and U.S. Pat. No. 4,428,160 ("WILLEMSEN"). Though the needs for increased simplicity and decreased cost have long been felt in the art, many developments in this field of technology accomplish the opposite.

Another interesting aspect of the prior art involves the use of a stop member for positioning the end of the valve stem that is opposite to the tulip part of the valve to limit the regrinding of the valve face. For example, MURRAY uses stop 54 and WILLEMSEN uses stop member 57 for this purpose. However, the invention disclosed hereinafter reflects the view that the use of this kind of stop member is a mistake and contrary to the above-identified objects.

A further interesting feature of the prior art involves the variety of chuck mechanisms used to hold and/or support the valve stem during the regrinding of the valve face. It is not unusual in the prior art to support the valve by means located only at or near the ends of the stem. With reference to U.S. Pat. No. 1,452,508 ("HERVIG"), one pair of wheels 33 is located adjacent to the tulip end of the valve stem and another pair of wheels 33 is located at the opposite end of the valve stem. WILLEMSEN shows a similar chuck mechanism with wheels 22 located at one end of the valve stem and a support means 37 with a V-shaped groove 41 spaced from the tulip end of the valve stem. The invention disclosed hereinafter reflects the view that this type of configuration is not optimal in terms of the above-identified objects of the invention and does not reflect an appreciation of certain phenomena relating to valve stem regrinding.

SUMMARY OF INVENTION

The objects in the above-quoted prior art are incorporated by reference herein.

In addition, it is an object of the present invention to make a valve regrinder that is sufficiently inexpensive and simple to operate that it can be afforded by and used in gasoline service stations, as opposed to machine shops.

These and other objects will be appreciated from the detailed description of the present invention hereinafter.

With further reference to the use of a stop member as taught in the prior art, the end of a used valve stem frequently is not perfectly flat. Instead, it appears as though a chip has been worn off the end of the valve stem. In translating the pivoting motion of the rocker arm to the up and down motion of the valve stem, the force applied to the valve stem is not always coaxial with the stem. Rather, the force commences at an angle that changes as the rocker arm pushes the valve to its open position. The repeated contact between the rocker arm and the edge of the valve stem can, in cases of severe wear, extend a slanted area of wear substantially across the entire end of the valve stem.

The invention herein reflects the observation that applying a HERVIG-type pointed stop member against an uneven end of a valve stem causes the valve stem to "walk" in and out of the chuck during regrinding operations. In turn, this results in defects being ground into the valve face. In theory, a HERVIG-type stop member may suffice if it is perfectly centered at one point. It is difficult to always perfectly center a stop member at one point, however, because of the range of valve stem diameters in use today. Thus, the first step in reqrinding a valve frequently involves flattening the end of the valve stem on a grinding wheel, so that the regrinding machine will work properly. A similar result occurs when a WILLEMSEN-type stop member, which resembles a plate, is not perfectly perpendicular to the valve stem.

Accordingly, the use of a stop member to limit the regrinding, particularly where objects of the invention include simplification and reduced expense, is a mistake. Rather than using a stop member to limit the regrinding, in the invention herein, the face of the valve is drawn against an abrasive means which perceptibly changes the finish of the valve face; this change in the finish, rather than abutment against a stop member, is used to signal the operator that the regrinding is complete.

With regard to the chuck mechanisms generally used in the prior art, two features of valve stem wear are of interest. First, as the rocker arm impacts the end of the valve stem at an angle, it not only pushes the valve down, but it also pushes the valve at an angle against the valve guide of the engine head or block. This tends to result in a first notch being worn into the valve stem near the tulip end of the stem and a second notch being worn near the distal end of the stem. Where there is no rotation imparted to the valves, the notches tend to be worn in opposite "sides" of the stem, i.e., at locations 180 degrees apart with respect to the circumference of the valve stem. The distance between the notches corresponds to the length of the valve guide, and the distance across each notch corresponds to the length of valve movement up and down in the guide. The depth of a notch depends on the amount of wear, but may be several thousandths of an inch deep for valves used in an automobile internal combustion engine. The mechanisms of the prior art that support or grip the valve stem in an area of this wear tend to cause a corresponding asymmetry to be ground into the valve face during the regrinding operation.

Second, the tulip end of the valve tends to be rendered asymmetrical by the hostile environment in which the valve operates, and carbon and other deposits abound in this region of a used internal combustion engine valve. Chuck mechanisms of the prior art that support or grip the valve stem in this region are also prone to translating this imperfection into the resurfacing of the face of the valve.

To solve these problems and accomplish the objects of this invention, a centerless valve regrinder is designed for resurfacing a worn valve. Each such valve has a face, a tulip connected to the face, a valve stem connected to the tulip (the stem having an axis), a first notch worn into the stem at a location spaced from the tulip, and a second notch worn into the stem at a location opposite to the tulip end. The regrinder has a power-driven abrading surface for resurfacing the valve face, a chuck for screwing the valve face against the abrading surface, and means for selectively adjusting the orientation of the chuck with respect to the abrading surface, in order to select the correct valve face bevel. The chuck has a power-driven wheel for frictionally engaging the valve stem to rotate the stem about its axis. The wheel is angled slightly with respect to the axis of the stem, so as to screw the valve into the chuck until the valve face contacts the abrading surface, and then to keep the face pressing against the abrading surface. The chuck also has two elongated, fixed supports in parallel orientation, which are of sufficient length to cradle and support the valve stem from respective points adjacent to the tulip end of the valve stem to respective points past at least the first notch (near the tulip end of the stem), and preferably past the second notch (at the opposite end of the stem) as well. The elongated supports (which can be provided by a V block) tend to "even out" deformities and provide support over the notch wear area(s) from elsewhere on the stem. A preferred embodiment has a chuck devoid of any stop member used to limit the regrinding of the valve by contacting the distal end of the valve stem. A change in the finish of the valve face caused by the resurfacing is used to signal when the regrinding is complete. Regrinding normally is complete when no surface is left on the valve face that is not substantially completely dressed.

DETAILED DESCRIPTION

Figure 1:
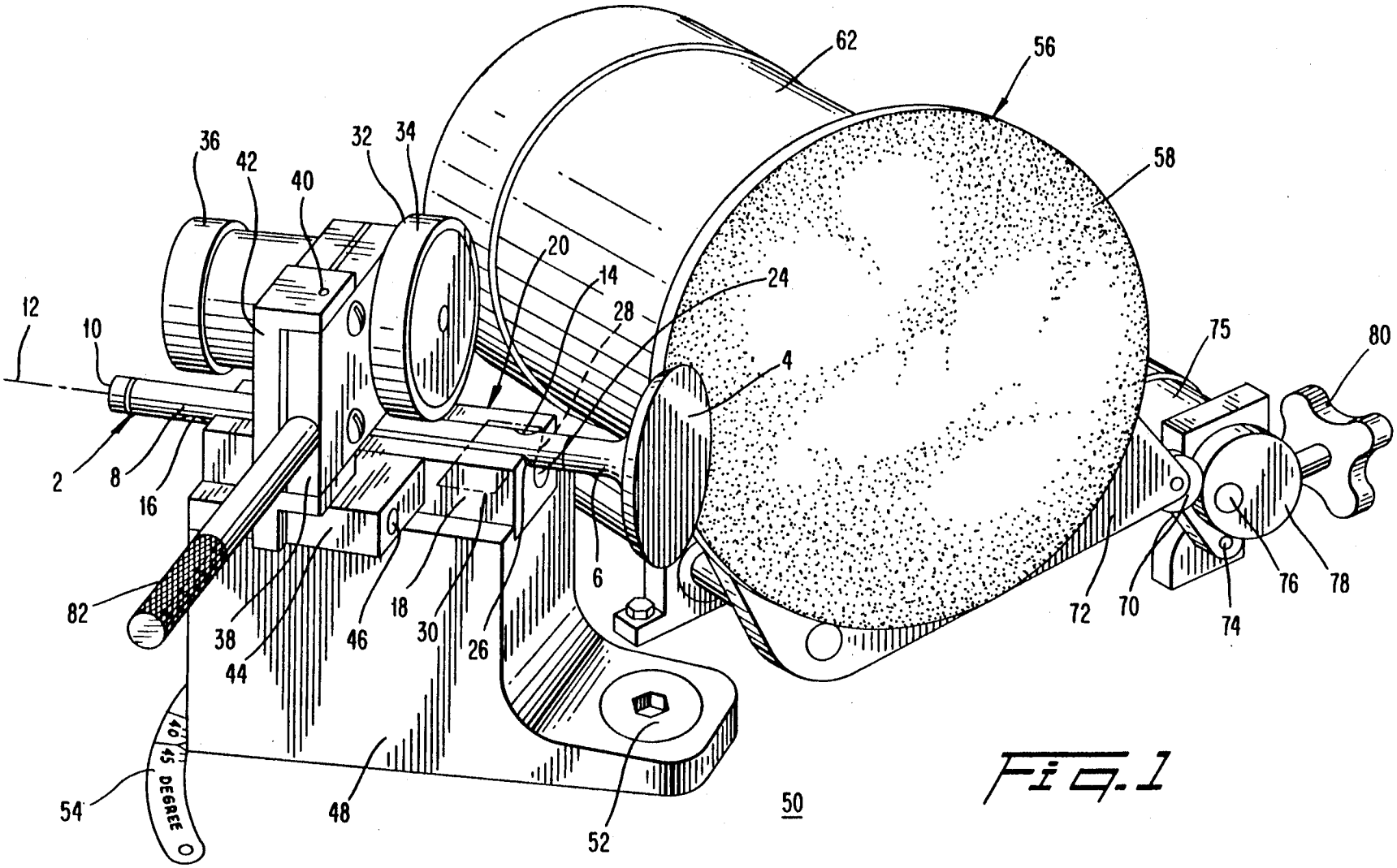
FIG. 1 is a perspective view of one embodiment of the present invention.

With reference to FIG. 1, there is shown a used valve 2 having a face 4, a tulip 6 connected to the face 4, and a valve stem 8 connecting the tulip 6 with a distal end 10, the stem 8 having an axis 12. The stem 8 has a first notch 14 worn into stem 8 at an area spaced from tulip 6 and a second notch 16 worn into stem 8 at an area spaced from end 10 of valve stem 8.

Valve 2 is held in chuck 18 which is comprised of a V block 20 made of ultra high molecular weight polypropylene, which is very tough but not hard. V block 20 has two supports, 22 and 24, respectively, to cradle and support valve stem 8 along its length to a sufficient extent to "even out" deformities and overcome one or more worn areas, such as notches 14 and 16, with support from elsewhere along the stem. A V block requires a length sufficient to support the valve. While valves range in size up to about at least a yard long, a V block in the range of about an inch to a foot in length should suffice for most valves. For automobile engine valves, a V block in the range of about three to six inches should support most valves. The "V" of the V block 20 should be sized and angled such that the "shoulders" of the V block, 26 and 28, respectively, define a plane 30 that will be interrupted when valve stem 8 is inserted for regrinding in the V block 20. Shoulders 26 and 28 may be pointed or squared-off. A V block 20 may be adapted to support and cradle valve stem 8 totally within the "V" by removing a notch from the V block 20 to enable the valve to be rotated at a position lower in the "V." Preferably, the axis 12 of the valve stem 8 should not be within the area confined by plane 30 and the "V" of V block 20, but valve stem 8 should contact the "V" of V block 20 below the shoulders 26 and 28.

Within chuck 18, valve 2 is rotated in the V block 20 by screw-in means 32, for example, a rubber-faced drive wheel 34 which rotates in the counterclockwise direction. The axis of rotation of wheel 34 is angled with respect to the axis of valve stem 8, so as to screw valve stem 8 into the V block 20. In FIG. 1 a small induction motor 36 produces a slow enough speed to rotate valve 2 clockwise at about 10 rpm.

Motor 36 and drive wheel 34 are mounted on plate 38 which, in turn, is rotatably fastened by a pivot 40 to bracket member 42. Bracket 42, in turn, is rotatably fastened to ledge 44 by pivot pin 46. Ledge 44 is mounted to base 48. Base 48 is connected to table surface 50 by bolt 52, which adjustably holds base 48 at a selectable position shown on scale 54 of table surface 50. Most valve faces for internal combustion engines are bevelled at an angle of either 30 degrees or 45 degrees. Scale 54 shows the proper position of base 48 for at least those two angles.

In order to regrind valve 2, valve face 4 is brought into contact with means for resurfacing 56. In FIG. 1, the means for resurfacing 56 is comprised of an abrading surface such as an adhesive-backed sandpaper disc 58 carried on a steel disc 60 mounted on the shaft (not shown) of large induction motor 62. Other powerable planar abrading means, such as a belt sander, may alternatively be employed. Large induction motor 62 turns counterclockwise at approximately 3,000 rpm. Sandpaper disc 60 is made of 150 grit garnet paper. Large induction motor 62 is rotatably secured through pivot ear 64 of its housing by large pivot pin 66 and a pair of shackles 68 to table surface 50. An idler wheel 70 is rotatably carried by another ear 72 of the large induction motor 62 housing. Hinge 74 connects table surface 50 with a third induction motor 75 having a drive shaft 76. Eccentric cam wheel 78 is mounted on drive shaft 76. Idler wheel 70 rests on cam wheel 78. As cam wheel 78 rotates (at about 40 rpm) motor housing ear 72 rises and falls with each rotation, thereby pivoting motor 62 around large pivot pin 66. The rising and falling keeps the sandpaper disc 58 from being worn in a narrow ring. Screw 80 is threaded through a brace (not shown) which is connected to table 50. Screw 80 rests against hinge 74 to adjustably elevate the range of rising and falling, to compensate for different diameter valves seating at different positions in the "V" of V block 20. Sandpaper disc 58 should rise and fall about its radial intersection with valve face 4.

In order to use the present invention, valve 2 is placed in V block 20. Handle 82 is temporarily depressed, which pivots drive wheel 34 up and out of the way, until valve 2 is inserted into V block 20. The plane of rotation of drive wheel 18 is not quite perpendicular to the axis of valve stem 8. Thus, when powered, drive wheel 18 will draw the face 4 of valve 2 toward V block 20 and, ultimately, against sandpaper disc 42.

The angle formed by the axis of valve stem 8 and the plane of sandpaper disc 58 equals the angel of bevel desired on the valve edge. This angle is controlled by loosening bolt 52, pivoting base 48 to predetermine the angle of regrinding shown with respect to scale 54, and then tightening bolt 52 to secure the position of base 48. Sandpaper disc 58 protrudes into the area behind the face of valve 2, so that as the face 4 is drawn toward V block 20, it comes into contact with rotating sandpaper disc 58 at the proper angle. The reciprocal pivoting of motor 62 caused by the rotation of cam wheel 79 widens the path of contact of the face 4 of valve 2 with sandpaper disc 58.

The pressure exerted by the constant pulling of the valve face 4 against disc 58 produces a finish that is observably different from that of a used valve that has not been reground. An evenly reground finish, not a stop or a stop member, indicates when the regrinding is complete.

When regrinding is complete, handle 82 is pushed to the left, about pivot 24, causing drive wheel 18 to ease the face 4 of valve 2 far enough away from the rotating sandpaper disc 42 to permit the operator to safely grasp and remove the valve 2.

Figure 2:
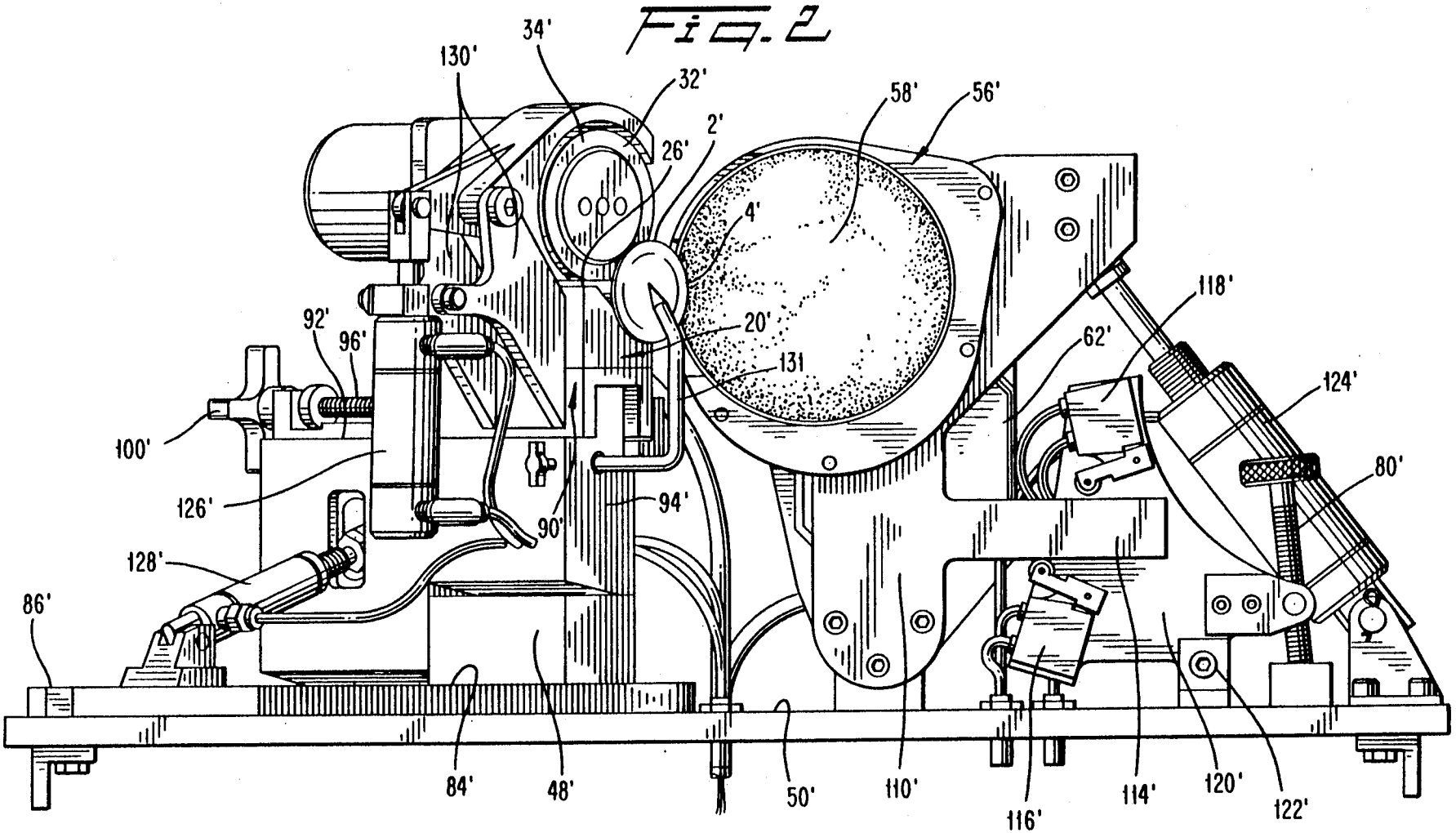
FIG. 2 is a front elevational view of another embodiment of the present invention.
Figure 3:
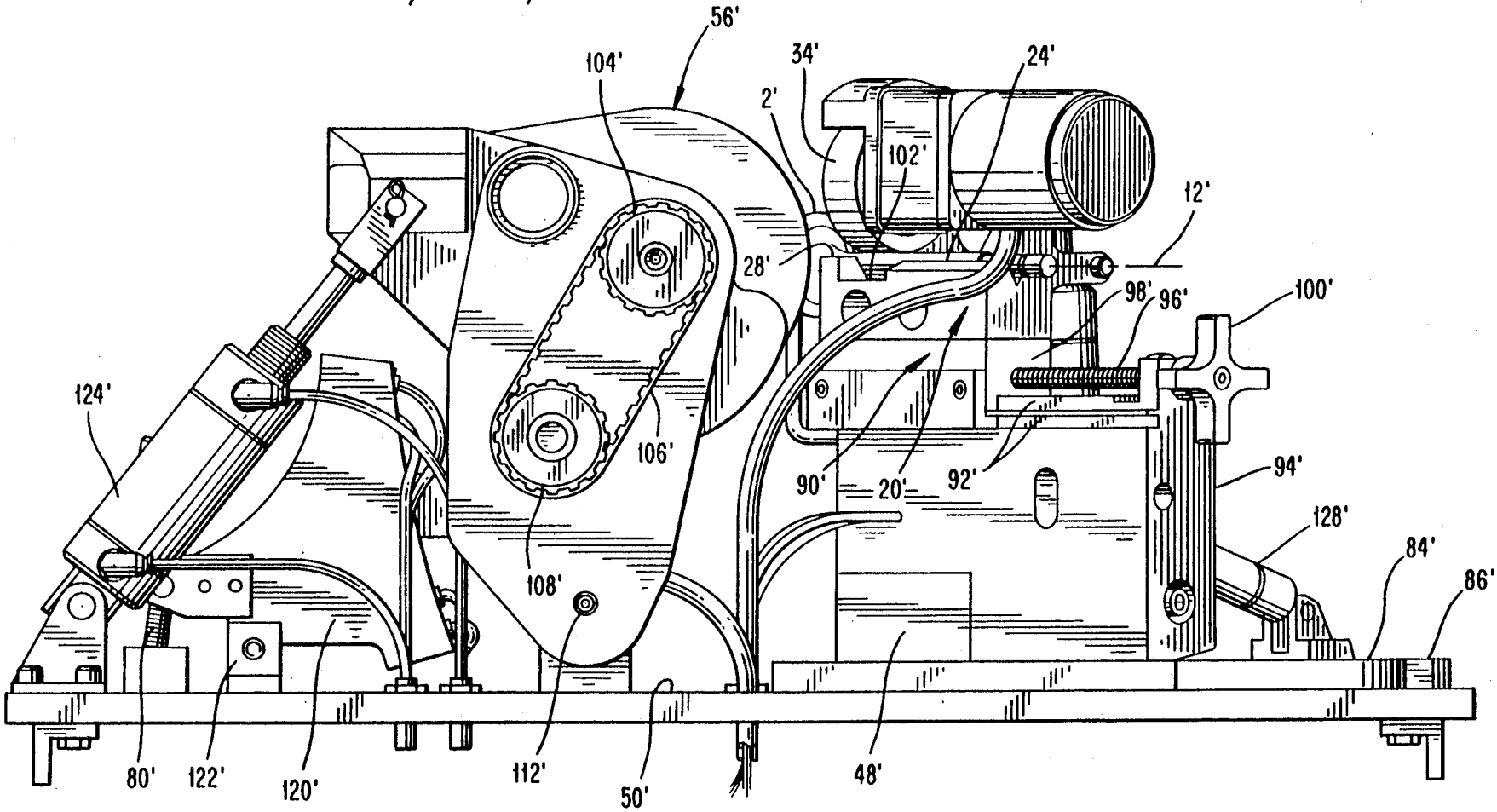
FIG. 3 is a rear elevational view of the embodiment shown in FIG. 2.
Figure 4:
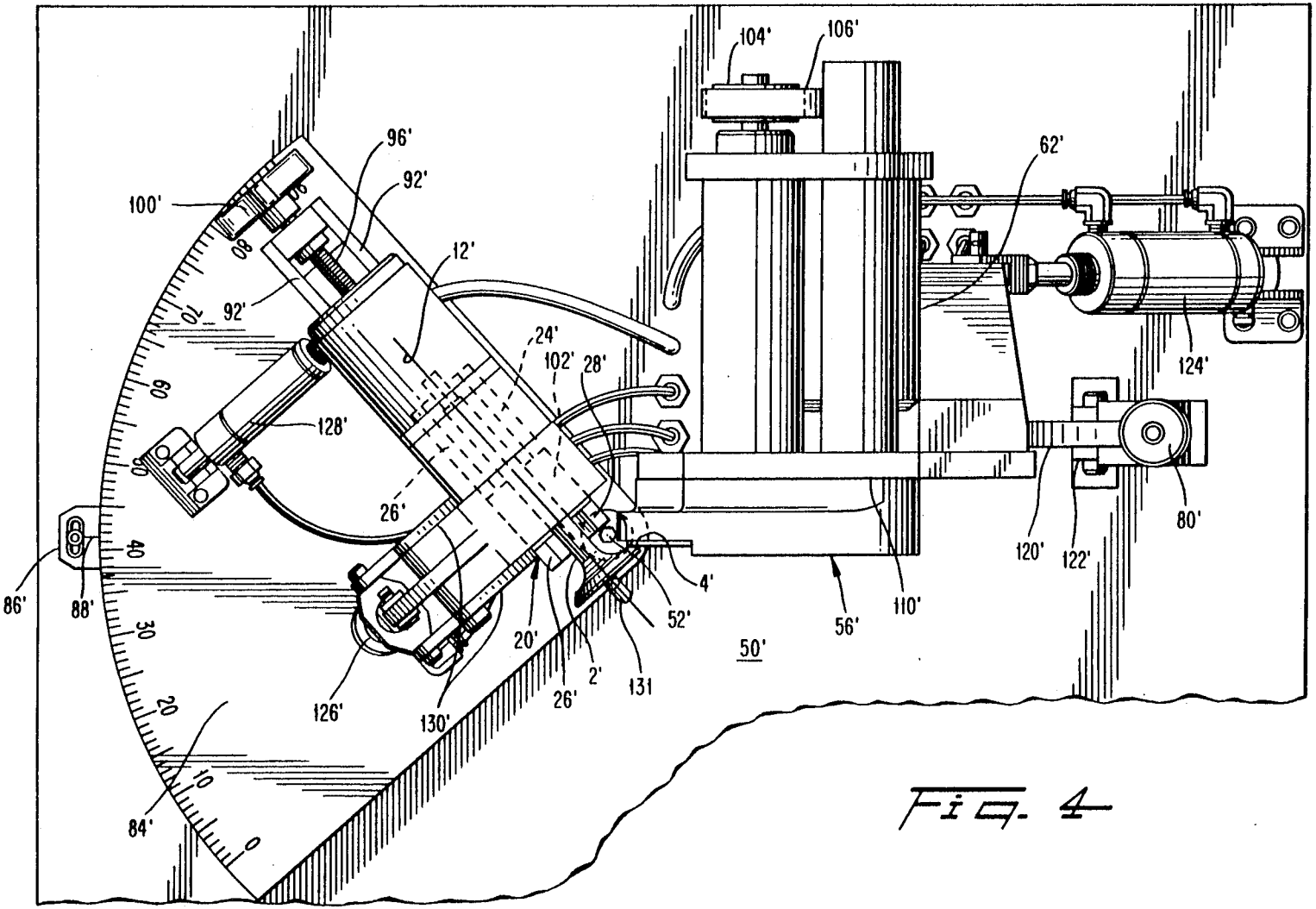
FIG. 4 is a top plan view of the embodiment shown in FIG. 2.

Additional features of the invention are shown in FIG. 2, FIG. 3, and FIG. 4. Between base 48' and table surface 50', there is a circular segment 84' on which degrees are inscribed along the arc. Mounted also to table surface 50' is marker 86', which provides a fixed reference point to coincide with degrees of angle that are marked on circular segment 84'. Circular segment 84' is bolted to table surface 50' by bolt 52' for adjustably pivoting base 48' to the desired regrinding angle shown on segment 84' at mark 88'. Chuck 18' includes a sled 90' that is movably mounted on rails 92' attached to shoulder 94'. Sled screw 96' helically pierces block 98' integral with shoulder mount 94'. Sled screw 96' is secured to handle 100' and rotatably mounted to sled 90'. In operation, screw 96' is rotated by hand to move sled 90' closer to, or farther from, the marker 86'.

Mounted to sled 90' is V block 20'. V block 20' provides two rigid supports 22' and 24', respectively, for supporting valve stem 8' along substantially its entire length, except for a partial notch 102' in V block 20'. Partial notch 102' pierces both shoulders 26' and 28' of the V block 20' intermediate their respective ends, but preferably does not completely pierce or terminate the length of supports 22' and 24'. Notch 102' allows wheel 34' to rotate valve 2' about its stem axis 12' and draw the valve face 4' into contact with means for resurfacing 56'.

Means for resurfacing 56', for example, a sandpaper disc 58' is mounted to a disc (not shown), which is rotated by means of a bearing-supported axle (not shown) to a first toothed drive wheel 104'. A toothed-belt 106' connects the first drive wheel 104' to a second toothed drive wheel 108', the latter being mounted to the rotor (not shown) of an induction motor 62'.

The motor 62' and means for resurfacing 56' are held in a bracket 110' which is rockably connected to table surface 50' by pivot means 112'. Bracket 110' has an arm 114' which projects between switches 116' and 118'. These switches are mounted by means of foot plate 120' and pivot means 122' to table surface 50'. Set screw 80' is adapted to adjustably confine the extent of pivoting by foot plate 122'.

FIG. 2, FIG. 3, and FIG. 4 together show three air cylinders which can be powered and controlled by such means (not shown) as is known in the art. In lieu of the eccentric cam wheel 79, idler wheel 70, motor 76, etc., shown in FIG. 1, FIG. 2 shows a first piston 124' pivotally mounted to connect the means for resurfacing 56' with table surface 50' for rocking the means for resurfacing 124'. The piston 124' is triggered by switches 116' and 118'. The rocking in a plane parallel to the face of the sanding disc 58' keeps the face 4' of valve 2' from wearing a narrow ring in sandpaper disc 58' by moving the means for resurfacing 56' to bring more than a narrow area of sandpaper disc 58' into contact with valve face 4'.

In lieu of the handle 82, etc., for pivoting screw-in means 32 in FIG. 1, FIG. 2 shows second piston 126' pivotally mounted between double-Y brace 130' and screw-in means 32'. Second piston 126' serves to raise screw-in means 32' up from V block 20'. In this orientation, valve stem 2' is easily inserted, or later removed, from V block 20'.

A third piston 128' is pivotally mounted between shoulder mount 94' and table surface 50' to move shoulder mount 94' toward or away from the means for resurfacing 56'. The pivoting is used for more safely allowing insertion and removal of the valve 2'.

A further addition in the FIG. 2 embodiment of the invention is finger 131, which is extendably inserted in V block 20'. Finger 131 is used for gauging how far forward the valve 2' should extend out of the V block 20' before commencing the regrinding. The purpose is to ensure that the valve face 4' will not miss the sandpaper disc 58' when piston 128' is activated.

Before commencing the regrinding operation using the apparatus of FIG. 2, the safe and proper position of components should be determined. The valve 2' should be positioned in V block 20' such that the axis 12' of the valve 2' contacts finger 131 at a position forward of the sandpaper disc 58'. Thereafter, piston 128' is activated to bring the V block 20' in closer proximity to the sandpaper disc 58'. Motor 62' is powered and piston 124' is activated to rock the sandpaper disc 58'. Thereafter, motor 36' is powered and then piston 126' is deactivated to lower screwing means 32' onto valve 2'. Screw-in means 32' draws the valve face 4' into rotative contact with sandpaper disc 58', which changes the finish of valve face 4'. Rather than using a stop member to limit the regrinding, when the finish is substantially continuous and uninterrupted by pits or blemishes, the regrinding is complete. Usually this can be determined by visual observation, without the aid of a microscope. The apparatus should be deactivated and the valve withdrawn in the reverse order specified in this paragraph.

I claim:

1. A centerless valve regrinder for resurfacing a worn internal combustion engine valve having a face, a tulip connected to said face, a valve stem connected to said tulip, said stem having an axis, a first notch worn into said stem at a location spaced from said tulip, and a second notch worn into said stem at a second location spaced from an end opposite said tulip, said regrinder comprising:

a power-driven means for resurfacing said valve face; and a chuck for supporting said valve stem to cause contact between said valve face and said means for resurfacing at an angle adjustably predetermined to bevel said valve face, said chuck being comprised of a drive wheel for rotating said stem about said axis and simultaneously drawing said valve face into contact with said means for resurfacing at said angle, and said chuck is further comprised of two fixed supports, in parallel orientation, and of sufficient length to cradle and support said stem from adjacent said tulip to respective points past said first notch.

2. The centerless valve regrinder of claim 1, wherein: said chuck is devoid of any stop member for contacting said end of said valve stem to limit regrinding when said valve is in said supports.

3. The centerless valve regrinder of claim 1, wherein: said supports extend from adjacent said tulip to respective points beyond said second notch.

4. The centerless valve regrinder of claim 2, wherein: said supports extend from adjacent said tulip to respective points beyond said second notch.

5. The centerless valve regrinder of claim 1, wherein: said supports have a length within the range of about three to six inches.

6. The centerless valve regrinder of claim 2, wherein: said supports have a length within the range of about three to six inches.

7. The centerless valve regrinder of claim 3, wherein: said supports have a length within the range of about three to six inches.

8. The centerless valve regrinder of claim 4 wherein: said supports have a length within the range of about three to six inches.

9. The centerless valve regrinder of claim 1, wherein: said supports are provided by a V block with shoulders which define a plane that will be interrupted by said valve stem when said valve is inserted in said chuck.

10. The centerless Valve regrinder of claim 2, wherein:

said supports are provided by a V block with shoulders which define a plane that will be interrupted by said valve stem when said valve is inserted in said chuck.

11. The centerless valve regrinder of claim 3, wherein:

said supports are provided by a V block with shoulders which define a plane that will be interrupted by said valve stem when said valve is inserted in said chuck.

12. The centerless valve regrinder of claim 4, wherein:

said supports are provided by a V block with shoulders which define a plane that will be interrupted by said valve stem when said valve is inserted in said chuck.

13. The centerless valve regrinder of claim 9, wherein:

said axis of said valve stem will be in a plane above said shoulders when said valve is inserted in said chuck.

14. The centerless valve regrinder of claim 10, wherein:

said axis of said valve stem will be in a plane above said shoulders when said valve is inserted in said chuck.

15. The centerless valve regrinder of claim 11, wherein:

said axis of said valve stem will be in a plane above said shoulders when said valve is inserted in said chuck.

16. The centerless valve regrinder of claim 12, wherein:

said axis of said valve stem will be in a plane above said shoulders when said valve is inserted in said chuck.

17. The centerless valve regrinder of claim 1, wherein:

said supports are faces of a V block with shoulders which define a plane for intersecting with said valve when said valve is inserted in said chuck; and wherein said V block is notched to cut away a portion, but not all, of said faces, for allowing contact between said drive wheel and said valve without interrupting continuous support for said valve stem.

18. The centerless valve regrinder of claim 2, wherein:

said supports are faces of a V block with shoulders which define a plane for intersecting with said valve when said valve is inserted in said chuck; and wherein said V block is notched to cut away a portion, but not all, of said faces, for allowing contact between said drive wheel and said valve without interrupting continuous support for said valve stem.

19. The centerless valve regrinder of claim 3, wherein:

said supports are faces of a V block with shoulders which define a plane for intersecting with said valve when said valve is inserted in said chuck; and wherein said V block is notched to cut away a portion, but not all, of said faces, for allowing contact between said drive wheel and said valve without interrupting continuous support for said valve stem.

20. The centerless valve regrinder of claim 4, wherein:

said supports are faces of a V block with shoulders which define a plane for intersecting with said valve when said valve is inserted in said chuck; and wherein said V block is notched to cut away a portion, but not all, of said faces, for allowing contact between said drive wheel and said valve without interrupting continuous support for said valve stem.

21. The centerless valve regrinder of claim 1, wherein:

said supports are provided by a V block made of ultra high molecular weight polypropylene; and said means for resurfacing is comprised of a sanding disc connected to a motor and said motor is held by means for rocking said motor in a plane parallel to said sanding disc.

22. The centerless valve regrinder of claim 2, wherein:

said supports are provided by a V block made of ultra high molecular weight polypropylene; and said means for resurfacing is comprised of a sanding disc connected to a motor and said motor is held by means for rocking said motor in a plane parallel to said sanding disc.

23. The centerless valve regrinder of claim 3, wherein:

said supports are provided by a V block made of ultra high molecular weight polypropylene; and said means for resurfacing is comprised of a sanding disc connected to a motor and said motor is held by means for rocking said motor in a plane parallel to said sanding disc.

24. The centerless valve regrinder of claim 4, wherein:

said supports are provided by a V block made of ultra high molecular weight polypropylene; and said means for resurfacing is comprised of a sanding disc connected to a motor and said motor is held by means for rocking said motor in a plane parallel to said sanding disc.

25. A centerless valve regrinder for resurfacing the face of a worn internal combustion engine valve consisting essentially of a straight stem having a valve tulip on one end, said tulip having an upper surface that is substantially perpendicular to the axis of the stem and a fluted undersurface that joins with the stem, said undersurface having a beveled face ground therein, said stem also having a distal end, a notch worn in said stem at a location spaced from said tulip, and a second notch in said stem at a location spaced from said distal end, said regrinder comprising:

a power-driven planar abrading means for abrading said valve face; and a chuck for rotatably holding and longitudinally drawing said valve by said stem in such a position that said valve face contacts said abrading means at an angle, said chuck including means for biasing said valve against said abrading means by continuous, unimpeded urging of said stem and said chuck being devoid of any stop member for contacting said distal end of said valve when said valve is inserted in said chuck.

26. The apparatus of claim 25, wherein said angle is adjustably determinable.

27. The valve regrinder of claim 26, wherein:

said chuck is further comprised of two elongated and rigid supports, said supports being in parallel orientation and of sufficient length to cradle and continuously support said stem from a distance adjacent said tulip to a distance past said first notch.

28. The valve regrinder of claim 27, wherein:

said supports constitute a V block comprised of ultra high molecular weight polypropylene.

29. The valve regrinder of claim 25, wherein:

said chuck is further comprised of a wheel disposed for frictionally engaging said stem to rotate said stem about its axis and for simultaneously draw said valve face into contact with said abrading surface.

* * * * *